US008109691B2

(12) United States Patent
Clark

(10) Patent No.: US 8,109,691 B2
(45) Date of Patent: Feb. 7, 2012

(54) APPARATUS AND METHOD FOR ON SITE POURING OF PRE-STRESSED CONCRETE STRUCTURES

(75) Inventor: James R. Clark, El Macero, CA (US)

(73) Assignee: Clark Pacific Technology, Inc., West Sacramento, CA (US)

( * ) Notice: Subject to any disclaimer, the term of this patent is extended or adjusted under 35 U.S.C. 154(b) by 186 days.

(21) Appl. No.: 12/702,796

(22) Filed: Feb. 9, 2010

(65) Prior Publication Data

US 2011/0194897 A1 Aug. 11, 2011

(51) Int. Cl.
*E04B 1/06* (2006.01)

(52) U.S. Cl. ..... 404/72; 52/742.14

(58) Field of Classification Search ..... 52/223.6, 52/223.14, 742.13, 742.14, 742.15; 404/70, 404/72

See application file for complete search history.

(56) References Cited

U.S. PATENT DOCUMENTS

| | | | | |
|---|---|---|---|---|
| 3,049,786 | A | | 8/1962 | Jones |
| 3,260,024 | A | | 7/1966 | Greulich |
| 3,422,586 | A | * | 1/1969 | Parma ..... 52/223.14 |
| 3,475,529 | A | * | 10/1969 | Johnson ..... 264/228 |
| 3,552,074 | A | * | 1/1971 | Rajchman ..... 52/223.14 |
| 3,882,651 | A | * | 5/1975 | Gilchrist ..... 52/223.6 |
| 4,574,545 | A | | 3/1986 | Reigstad et al. |
| 4,621,943 | A | | 11/1986 | Swanson |
| 4,700,516 | A | | 10/1987 | Grossman |
| 4,953,280 | A | | 9/1990 | Kitzmiller |
| 6,416,693 | B1 | | 7/2002 | Lockwood |
| 6,773,650 | B1 | | 8/2004 | Longo |

OTHER PUBLICATIONS

PCI Design Handbook Precast and Prestressed Concrete, 6th Edition (MNL-120-04) published by the Precast/Prestressed Concrete Institute, Chicago, Illinois, 2004.

PCMAC Technical Update "Interstate 10 Precast Demonstration Project" David K. Merritt, P.E., B. Frank McCullough, Phd, P.E., and Ned H. Burns, Phd, P.E., published by the Precast/Prestressed Concrete Manufacturers of California, Glendale, California, Jan. 2005.

* cited by examiner

*Primary Examiner* — Gary S Hartmann
(74) *Attorney, Agent, or Firm* — R. Michael West

(57) ABSTRACT

An apparatus and method for on site pouring of pre-stressed concrete structures. A form, having elongated sides spanned by first and second bulkheads at each end, is assembled on a building site. The form defines the size and configuration of a structure, and has an upper edge determining the upper surface of the structure. A transportable cable pre-stressing frame is provided, having a first end and a second end with respective outrigger assemblies and at least one pre-stressed cable extending therebetween. Adjustable means are provided for positioning and maintaining the frame over and generally in longitudinal alignment with the form, the pre-stressed cable lying below the form's upper edge. Concrete is poured into the form, covering the cable. After curing is complete, the portions of the cable extending outside the concrete structure are cut, releasing the tension on the cable and transferring it to the concrete.

7 Claims, 7 Drawing Sheets

33
34
36
37
38
41
42
43
44
46
47
48
49
51
13

APPARATUS AND METHOD FOR ON SITE POURING OF PRE-STRESSED CONCRETE STRUCTURES

BACKGROUND OF THE INVENTION

1. Field of the Invention

The invention relates generally to apparatus for pouring pre-stressed concrete, used for roadways, walls, and structural beams and supports. More specifically, the invention pertains to and apparatus and a method, for pouring pre-stressed concrete structures in situ, through the use of a transportable cable stressing frame, positioned and maintained directly over a form for the concrete structure.

2. Description of the Prior Art

Pre-stressing concrete has long been recognized as a technique to increase the tensile strength of cast concrete structures. The method generally requires that high strength wires, cables, or rods, passing through the empty mold or form for the concrete structure, are pre-stressed under high tension using a calibrated tensioning fixture. Then, the concrete is poured into the mold or form, enveloping the pre-stressed wires or cables. After the concrete has cured, the wires outside the mold are cut from the tensioning fixture, transferring the compressive forces to the concrete through the bond between the wires or cables and the concrete.

The general principles of this technique are illustrated in U.S. Pat. No. 6,773,650, issued to Longo for a Prestressed Concrete Casting Apparatus And Method. The '650 patent illustrates a pre-stressing clamshell apparatus designed to cast cementitious power poles. In this arrangement, a plurality of stationary, cable pre-tensioning devices are lined up at a production facility. The movable clamshell mold surrounds each pre-tensioning fixture while the concrete is poured and allowed to set. Then, the mold is opened and lifted up, and then moved along to the adjacent fixture, where the process is repeated.

An Apparatus For Making Prestressed Structural Members is disclosed in U.S. Pat. No. 3,049,786, granted to Jones. This apparatus uses a cable pre-stressing fixture like that shown in the '650 patent, but relies upon a movable mold member 60. As concrete is poured into the mold member, the mold member is slid along the fixture until the entire poured structure is formed over the cables.

In U.S. Pat. No. 3,260,024, issued to Greulich, a Prestressed Girder is shown. This reference suggests that the girder can be constructed either at the prestressing plant or at the building site, using an apparatus such as that depicted in FIG. 1. A horizontal beam 3 includes jacks 1 mounted on opposing anchor members 2. The concrete pour is made over the cables and the underlying beam. There is no particular adaptation or suggestion how this apparatus might be used in the field, for example at a building site, other than simply transporting the same apparatus that is used at the prestressing plant to the building site.

Basically the same methods discussed above are used to manufacture pre-stressed concrete slabs or roadway segments. These concrete structures are used for new road construction, or for purposes of road repair. For example, in making a new freeway, or in repairing damaged portions of roadway, a concrete slab or roadway segment is manufactured at an off-site facility, using a cable pre-stressing apparatus and a form or mold arrangement associated with that apparatus. After the concrete is poured and cured, the slab is transported by truck or rail to the roadway site for installation. In preparing a bed within which the new slab is to rest, every effort is made to match the inclination, orientation, and depth of the bed with that of the new slab, so that a smooth roadway transition can be made between adjacent slabs. Notwithstanding these efforts, it is very difficult to effect a perfect match between the bed and the slab, and surface anomalies and gaps do occur between adjacent slabs.

Similarly, it is conventional that pre-stressed walls, beams, posts, and other concrete structures are manufactured at a production facility, where permanent fixtures are located for pre-stressing cables and forms are provided to determine the size and configuration of the concrete structures. As with the roadway slabs, after pouring and curing, these concrete structures must also be transported to a remote building site, off-loaded, and assembled or arranged as required.

SUMMARY OF THE INVENTION

The apparatus and method disclosed herein are specially adapted to manufacture pre-stressed concrete structures, such as roadway segments, precisely at the site where the pre-stressed structure is to be used. Additionally, for other concrete structures, such as walls, beams, posts, and the like, production takes place at the same location where place of assembly or installation occurs.

This is accomplished by providing a transportable pre-stressing frame which is readily moved from pour site to pour site. This feature is useful, for example, when making interconnected roadway segments, arranged end-to-end, for a freeway. Transport of the pre-stressing frame from site to site can also be advantageous, where the building site is large or there is need for production of building components for multiple buildings in the same general area.

In contrast to prior art devices which generally employ a permanently mounted beam or frame on the floor of a manufacturing facility, the present device has a transportable pre-stressing frame, provided with downwardly directed outrigger assemblies at either end of the frame. The frame is initially positioned and then maintained in horizontal, spaced relation, above a form at a pour site, using adjustable mechanical, hydraulic, or electric jacks, or other equivalent raising and lowering devices. The form is typically comprised of opposing side structures or walls, spanned by opposing bulkheads at either end of the form. The length of the frame is such that each of the outrigger assemblies is located outside the form, adjacent a respective bulkhead.

Cables are secured to the outrigger assemblies at one end of the frame, and passed through the bulkheads to corresponding outrigger assemblies at the other end of the frame. The elevation of the cables is maintained below the upper edge of the form. Preferably, the cables are located mid-way between the floor of the form and upper edge. Each of the cables is pre-stressed to a predetermined tension, using conventional cable pre-stressing fixtures. With the form ready and the cables pre-stressed, concrete is poured into the form entirely covering the cables. With accelerators and other additives, concrete can be cured sufficiently in a number of hours, so that the tension forces in the cables can be released and transferred to the concrete slab as compressive forces. This is accomplished by cutting the cables at a point just past each end of the formed concrete slab, in a region between the outriggers and the bulkheads. The bulkheads are of split design, allowing their removal from around the cable and the end of the slab. The pre-stressing frame can then be lifted and removed from the site, and relocated to a new site.

Successive pours of slabs can be made, in end-to-end relation, to form a continuous roadway made from pre-stressed concrete poured on the site. Adjacent slabs are perfectly aligned, as the height of each form is readily adjusted to match the height of the adjacent slab, and the orientation and horizontal position of the form are likewise adjustable at the pour site.

The same apparatus and method can be used to manufacture walls, beams, posts, and poles on site, very near to where the concrete structure is eventually installed and utilized. Transportation costs and possible damage to the structures are reduced, as the structures do not have to be moved from a manufacturing facility. Lastly, the transportable frame can quickly be moved from construction site to construction site, as needed, improving the efficiency and speed of manufacturing and assembling concrete structures.

DETAILED DESCRIPTION OF THE PREFERRED EMBODIMENT

Figures 1, 2, 3, 4:
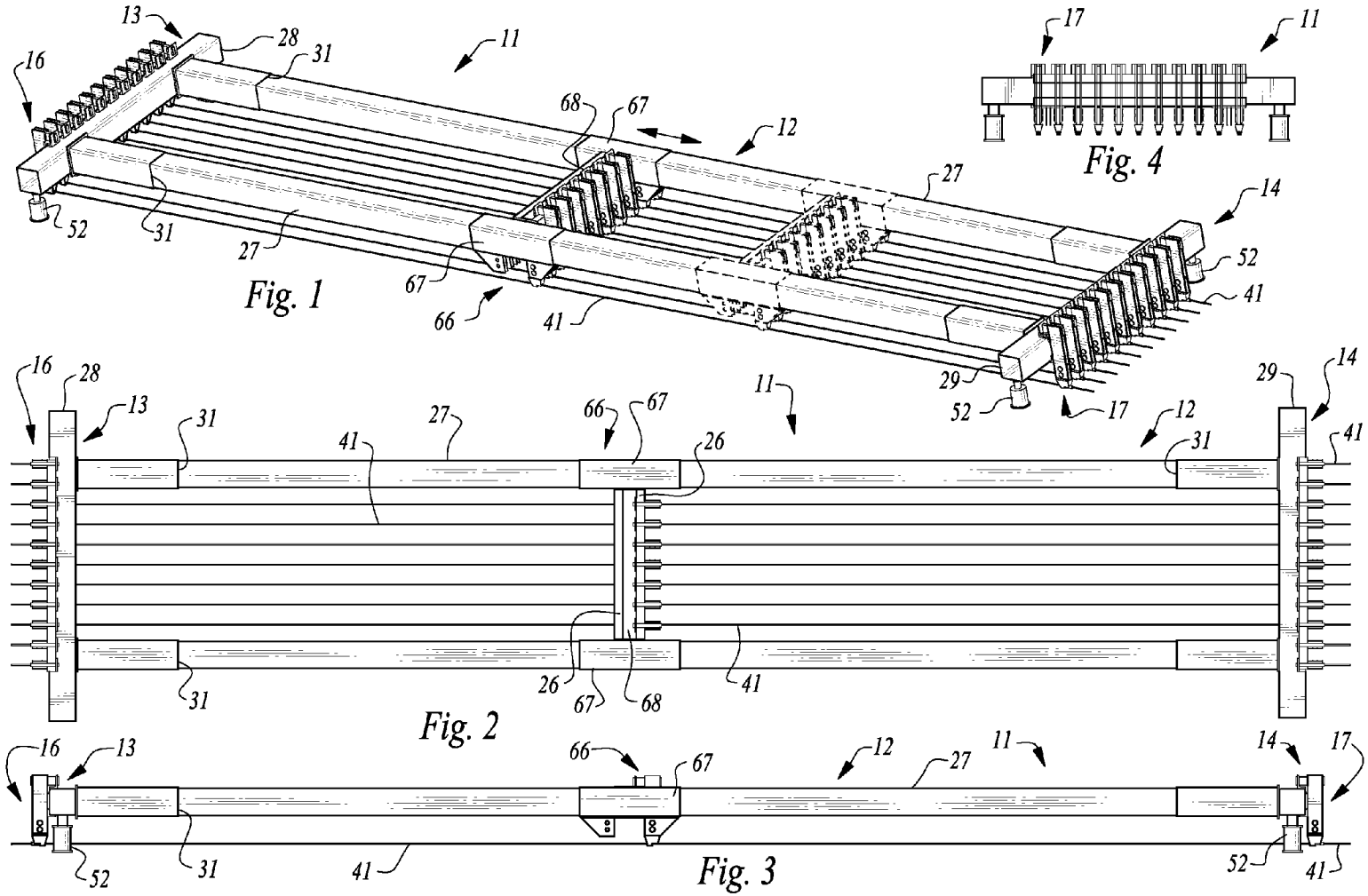
FIG. 1 is a perspective view of a pre-stressing frame fitted with a plurality of outriggers and associated cables, a secondary outrigger frame being shown in alternate positions along the frame side rails.
FIG. 2 is a top plan view of the pre-stressing frame of FIG. 1.
FIG. 3 is a side elevational view of the pre-stressing frame of FIG. 1.
FIG. 4 is an end elevational view of the pre-stressing frame of FIG. 1, showing a plurality of outriggers and the adjustable support jacks.
Figure 5:
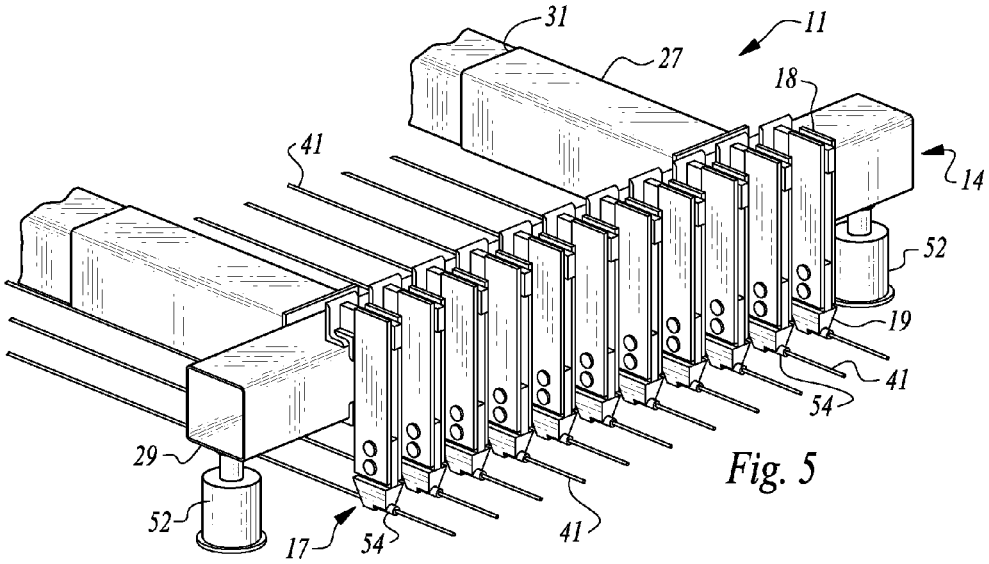
FIG. 5 is a fragmentary perspective view of one end of the pre-stressing frame.
Figure 6:
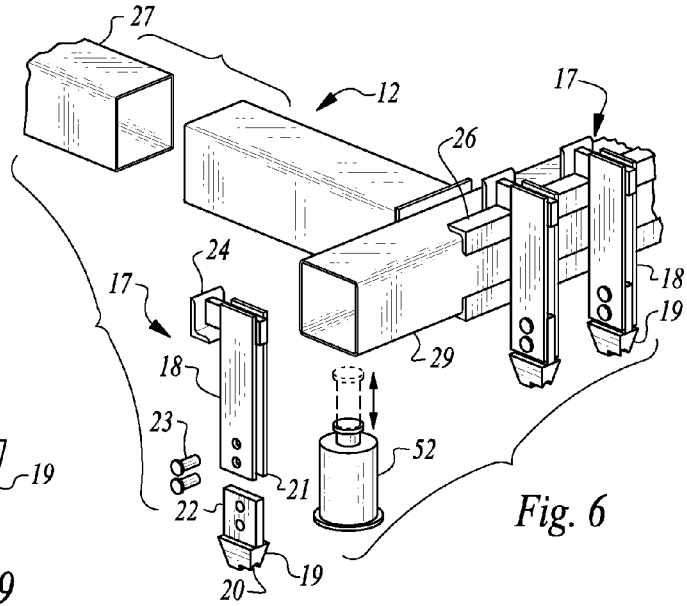
FIG. 6 is an exploded perspective view of an outrigger, showing a receiver and a cable restraint extension.
Figure 8:
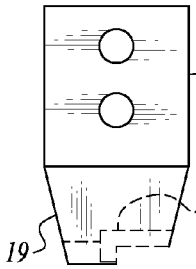
FIG. 8 is a side elevational view of a cable restraint extension, showing the chuck recess and cable passageway in broken line.
Figure 9:
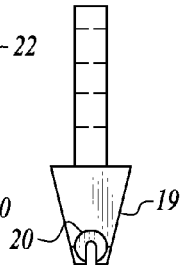
FIG. 9 is an end elevational view of a cable restraint extension, showing the chuck recess.

Turning now to the drawings, the apparatus 11 of the present invention includes an elongated cable pre-stressing frame 12, having a first end 13 and a second end 14. At least one first outrigger assembly 16 depends from the first end 13, and at least one second outrigger assembly 17 depends from the second end 14. In a typical setting, such as that shown in FIG. 1, a plurality of identical outrigger assemblies 16 and 17 are utilized at each end of frame 12.

As shown more particularly in FIGS. 5-9, each outrigger assembly 16 and 17 comprises a receiver 18 and a cable restraint extension 19. A chuck recess 20 is provided in the lower end of extension 19. Receiver 18 includes a slot portion 21 sized and configured to accept a tongue portion 22 of cable restraint extension 19. Removable pins 23 are provided selectively to secure cable restraint extension 19 within receiver 18. The upper end of receiver 18 is provided with an L-shaped bracket 24. The ends of frame 12 are provided with a length of angle iron 26, having an upper side arranged in spaced relation from the upper side of frame 12. A slot is thereby formed, so that a portion of bracket 24 can be slid within the slot, allowing outrigger assemblies to be mounted in the desired number and location along the end of frame 12.

Figures 28, 29, 30, 31, 32, 33:
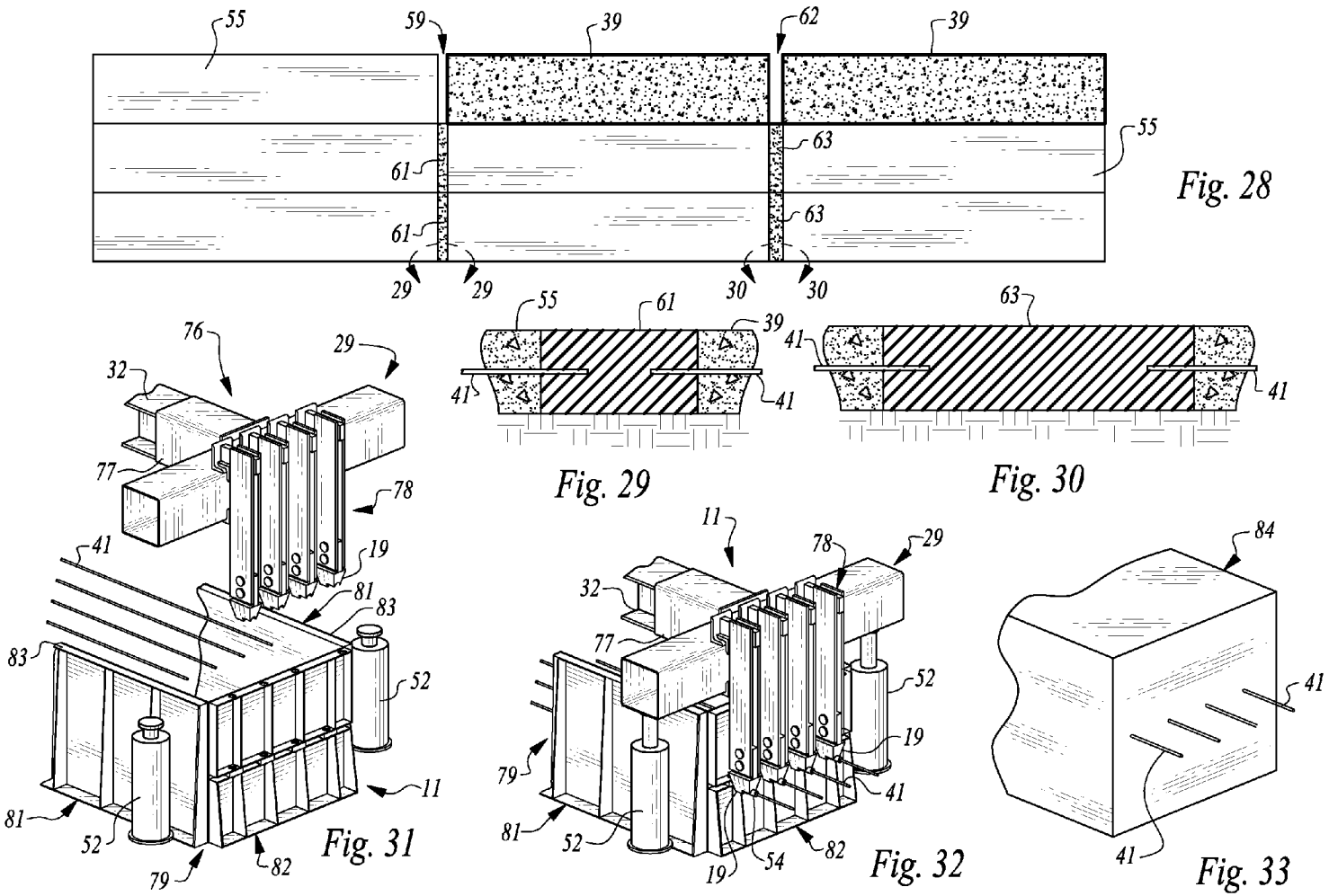
FIG. 28 is a top plan view of a roadway, showing adjacent newly poured roadway segments and the gaps therebetween forming expansion joints.
FIG. 29 is a cross-sectional detail view, taken on the line 29-29 in FIG. 28.
FIG. 30 is a cross-sectional detail view, taken on the line 30-30 in FIG. 28.
FIG. 31 is a fragmentary, exploded, perspective view of an end of an "I" beam pre-stressing frame in combination with a structural form for making pre-stressed concrete beams or posts.
FIG. 32 is a fragmentary, perspective view of the pre-stressing frame of FIG. 31 fitted with pre-stressed cables, shown in nested, overlying relation with the form; and, FIG. 33 is a fragmentary, perspective view of the pre-stressed beam or post, manufactured from the apparatus shown in FIG. 32.

In a preferred embodiment, frame 12 includes elongated side rails 27, arranged in parallel spaced relation, and transverse end rails 28 and 29. This construction provides a very strong structure against which the pre-stressed cables, discussed below, can be tensioned to predetermined specifications for manufacturing pre-stressed concrete structures. This construction also allows the frame 12 to be disassembled into a more compact configuration, in the event the side rails are provided with telescoping sleeve portions, suggested by joint lines 31. It may be desirable for manufacturing more narrow concrete structures, such as beams and posts, to fabricate frame 12 from a single I-Beam 32 fitted with transverse end rails 28 and 30. This alternative construction is shown in FIGS. 32 and 32 and will be discussed in more detail below.

Figures 10, 11, 12, 13:
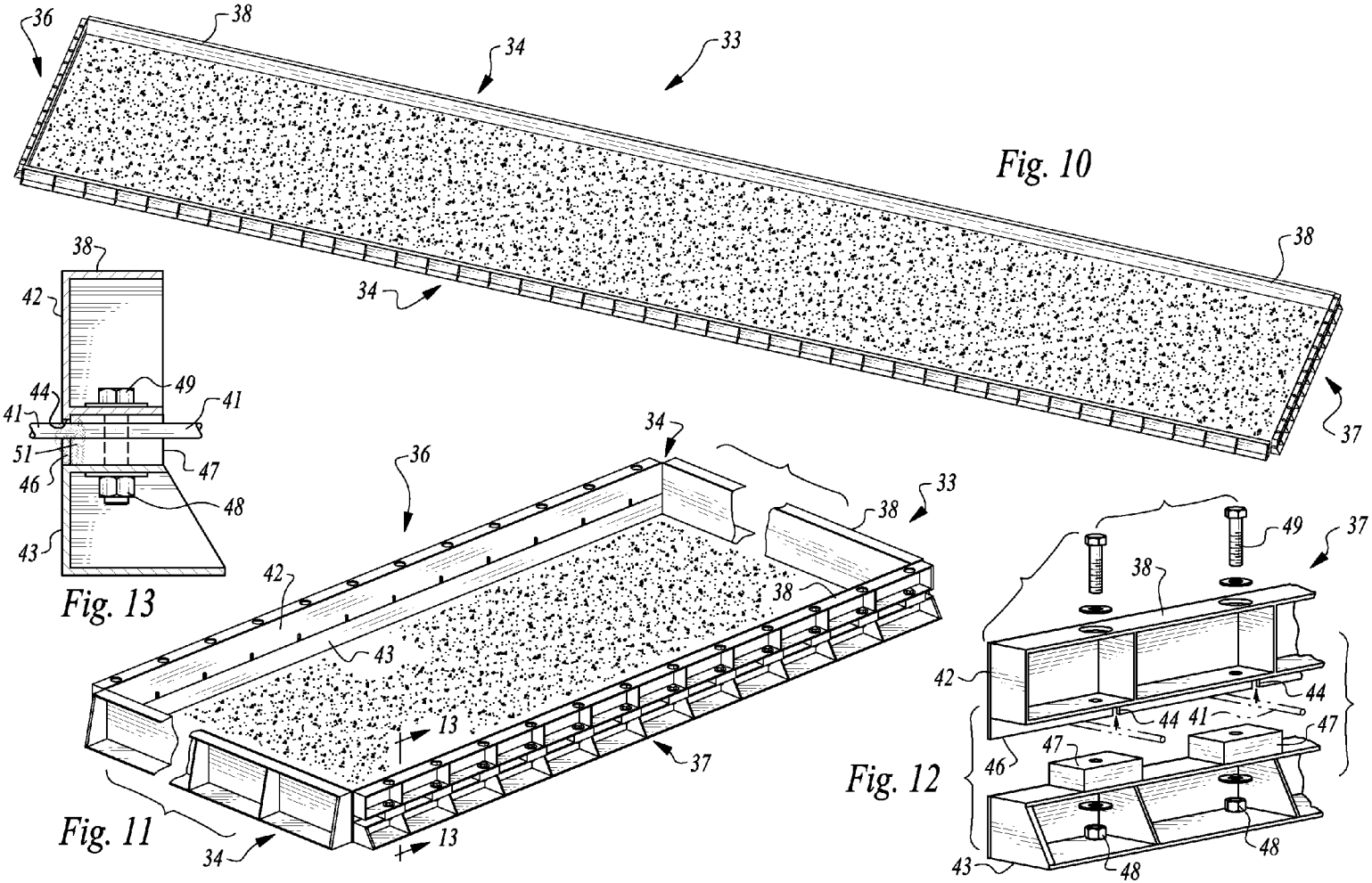
FIG. 10 is a perspective view of a typical structural form for a concrete roadway segment.
FIG. 11 is a fragmentary perspective view showing the split bulkheads used in the form of FIG. 10.
FIG. 12 is a fragmentary, exploded, perspective view of a split bulkhead, showing the upper plate and the lower plate and a pair of cables in phantom line.
FIG. 13 is a cross-sectional view taken on the line 13-13, in FIG. 11.

As illustrated in FIG. 10, the apparatus 11 also includes a form 33 which defines the shape and size of the concrete structure to be manufactured. Generally, form 33 has opposing elongated sides 34, and opposing first and second transverse bulkheads 36 and 37. However, the form can assume any desired geometric or irregular shape and size which is required for the application. It should be noted that form 33 has an upper edge 38 which defines the upper surface for the concrete structure to be manufactured using apparatus 11. In the event the apparatus 11 is being used to create a new roadway segment 39, the upper edge 38 lies in the same plane as adjacent roadway segments to create a smooth transition between adjacent roadway segments. In preparation, the floor surface surrounded by form 33 is typically graded as needed. The floor may also be covered with one or more layers of substrate material to form a bed for the pour.

Form sides 34 may be constructed from reinforced metal plates, wooden planks or the like, of conventional design. Since roadway segments 39 can extend up to 60' or so in length, it may be desirable to assemble sides 34 from a number of modular units (not shown), so as to make handling easier. On the other hand, breaking up sides 34 into a plurality of such units would require more labor to assemble and disassemble the apparatus when moving from pouring site to pouring site.

Bulkheads 36 and 37 are of split design, primarily to facilitate the passage of at least one pre-stressed cable 41 through the middle portion of each bulkhead. Making particular reference to FIGS. 12 and 13, each split bulkhead 36 and 37 comprises an upper plate 42 and a lower plate 43. Upper plate 42 includes at least one cutout 44 in a lower flange portion 46, allowing the passage of cable 41 therethrough. It is evident that the flange and the cutout provided on the upper plate could alternatively be placed on the lower plate with the same result. Spacer blocks 47 provide a sufficient gap between the lower side of plate 42 and the upper side of plate 43, to allow passage of cable 41 between the two plates. The plates are detachably affixed to each other by means of nuts 48 and bolts 49, to make assembly and disassembly of the bulkheads a relatively quick process. As is evident from FIG. 13, the inner sides of upper plate 42 and lower plate 43 provide a substantially planar surface for the inner ends of form 33.

Although the apparatus 11 includes at least one pre-stressed cable 41, the configuration of the apparatus shown in FIG. 1 includes a plurality of such cables. Each cable 41 extends from a cable restraint extension 19 of the first outrigger assembly 16 to a respective cable restraint extension 19 of the second outrigger assembly 17. In doing so, each cable 41 passes through cutouts 44 in first bulkhead 36 and in second bulkhead 37, in the manner explained above. It may also be desirable to apply caulking or packing 51 (See, FIG. 13), around each cable as it passes through the cutouts, to provide an adequate seal against leaks of the concrete to be poured.

Figure 14:
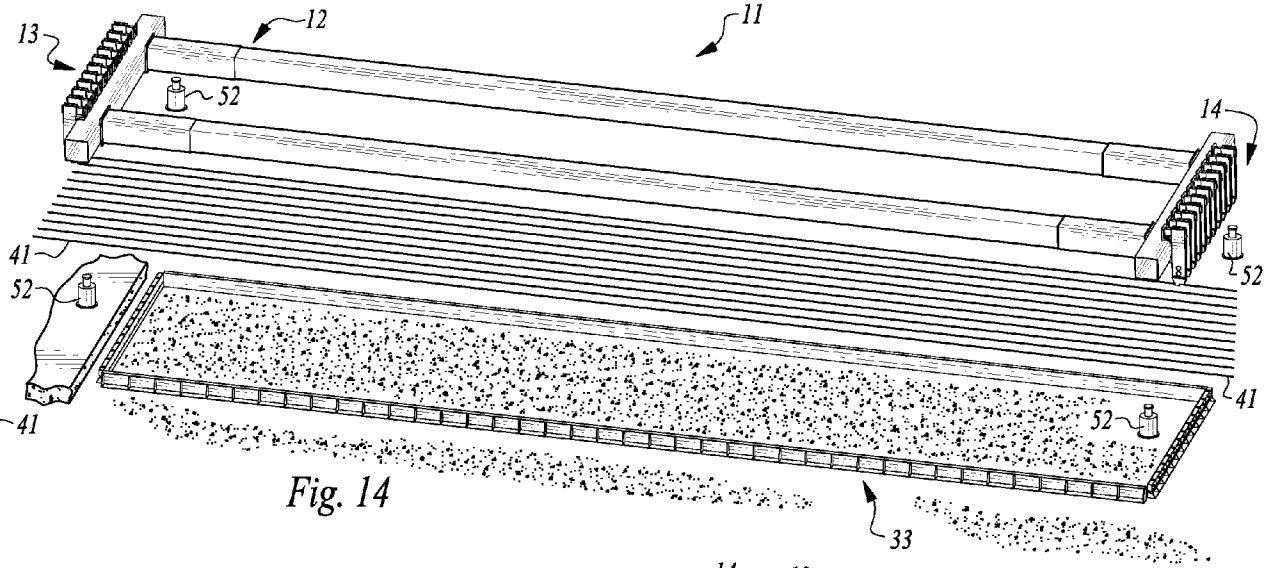
FIG. 14 is an exploded perspective view of a pour site for a roadway segment, showing the form, the cables, and the overlying pre-stressing frame.
Figure 18:
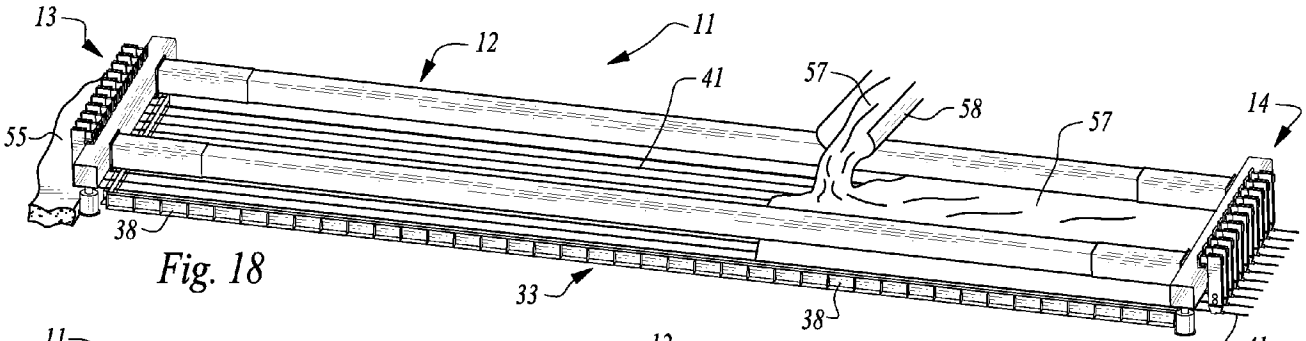
FIG. 18 is a perspective view of the pre-stressing frame and pre-stressed cables positioned over a form, showing the process of covering the cables with concrete and filling the form to an upper grade level at the top edge of the form.

Apparatus 11 further includes jack means 52, for positioning and maintaining elongated frame 12 over, and generally in longitudinal alignment with, form 33. Jack means 52 may be any conventional raising and lowering device, such as a mechanical, hydraulic, or electric jack. As shown in FIGS. 14 and 18, four such jacks 52 are used in most applications, two at each end of frame 12. Each jack 52 is positioned on the ground, or other adjacent supporting surface outside form 33. Then, frame 12 is properly oriented and lowered over form 33, supported solely by the jacks and maintained in spaced relation from the form. Using the height adjusting capabilities of the jacks 52, the elevation of the frame is set so that each of the pre-stressed cables 41 is lying below the upper edge 38 of form 33. Preferably, each cable 41 is located approximately mid-way in height, between the upper edge 38 and the floor, or lower grade level within form 33.

Figure 16:
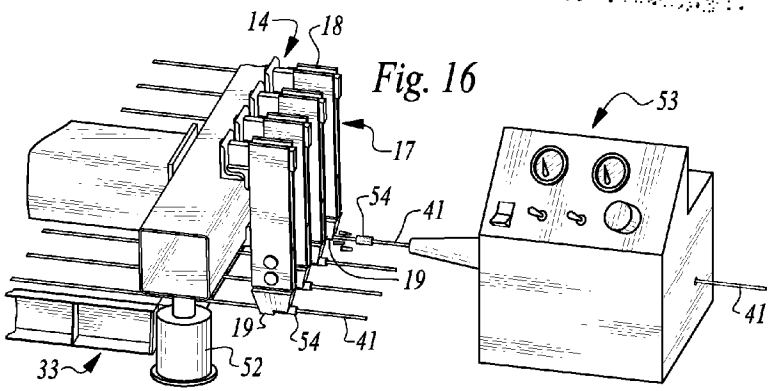
FIG. 16 is a fragmentary perspective view of the end of the pre-stressing frame, showing the cable pre-stressing fixture, a cable undergoing pre-stressing, and a locking chuck.
Figure 15:
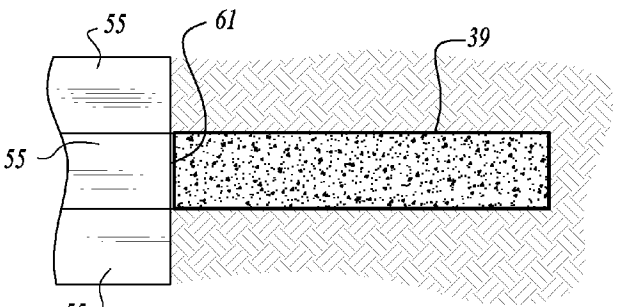
FIG. 15 is a top plan view of a roadway segment, after it has been poured in contingent relation to the end of an existing roadway.
Figure 17:
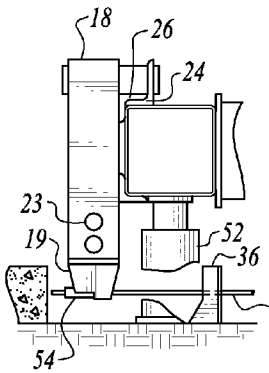
FIG. 17 is a fragmentary, side elevational view of an end of the pre-stressing frame, showing an outrigger assembly fitted with a pre-stressed cable, a portion of the jack and the bulkhead being broken away for clarity.

Each of the cables 41 is pre-stressed to a predetermined tension, by means of a conventional pre-stressing fixture 53, shown in FIG. 16. Enerpac, having world headquarters in Milwaukee, Wis., makes a number of suitable pre-stressing fixtures for use with the apparatus 11, including Models PTJ5S and 5DA1. Other examples of such fixtures include the PSI Hercules Stressing Systems stressing jacks, manufactured by Prestress Supply, Inc. located in Lakeland, Fla. Pre-stressing fixture 53 includes controls and gauges which determine the amount of tension to be placed upon each cable 41. Typically, tension forces within the range of 20,000 lbs. to 40,000 lbs. are applied, in accordance with the engineering specification for the pre-stressed concrete to be manufactured on site.

As a first step in the cable pre-stressing process, a pre-stress chuck 54, or other equivalent cable locking device, is engaged over one end of the cable 41, adjacent the cable restraint extension 19. The chuck 54 includes a forward nose portion that seats within chuck recess 20, provided in the lower end of cable restraint extension 19. Suitable pre-stress chucks include the Sure-Lock Splice Chuck and the Sure-Lock Strand Chuck, manufactured by MeadowBurke, located in Tampa, Fla.

Next, the pre-stressing fixture 53 is attached to the other end of the cable, adjacent a respective cable restraint extension 19, as illustrated in FIG. 16. After the fixture has been actuated and the predetermined cable tension reached, another chuck 54 is engaged between the cable and the cable restraint extension 19. This second chuck is effective to maintain the cable tension after the pre-stressing fixture is removed. After the second chuck 54 is locked in place, the pre-stressing fixture 53 can be removed from the tensioned cable, and relocated for attachment to any other cables remaining to be pre-stressed. In this manner, the plurality of cables 41 are pre-stressed to a predetermined tension, in preparation for the concrete pour.

Figure 19:
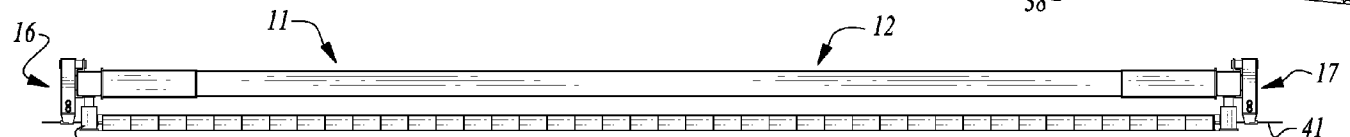
FIG. 19 is a side elevational view showing the pre-stressing frame and form of FIG. 18, prior to pre-stressing the cables.
Figure 20:
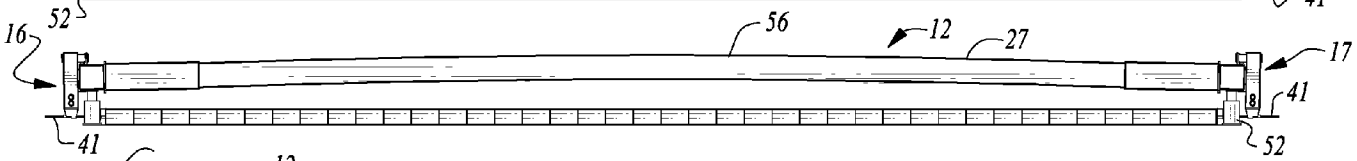
FIG. 20 is a side elevational view as in FIG. 19, after the cables have been pre-stressed with the pre-stressing frame bowed slightly upward under the stress.

FIGS. 19 and 20 depict the effects that cable pre-stressing has upon frame 12. In FIG. 19, the cables 41 are extending between the outriggers 16 and 17, but the cables have not yet been pre-stressed. In this state, frame 12 is linear in configuration, as suspended over form 33. As shown in FIG. 20, however, the cables 41 have been pre-stressed using the pre-stressing fixture 53, and it is evident that a slight bow 56 now exists in the side rails 27 of frame 12. Of course, being under substantial tension, the cables themselves remain straight, lying beneath the upper edge 28 of form 33.

FIG. 18 shows a new roadway segment 39 in the process of being poured, with one end of frame 12 adjacent an existing roadway segment 55. This circumstance will be encountered where an entirely new roadway is being constructed, and segments are being consecutively poured in end-to-end relation. Concrete 57, supplied through the chute of a cement truck (not shown), is delivered into the form 33 until it fills the form to reach upper edge 38. At that time, all of the cables 41 will be completely covered and immersed in concrete.

After the concrete has cured, the apparatus 11 can be removed from the pour site. To release the frame 12, all of the cables 41 are severed between the end of the new roadway segment 39 and respective cable restraint extensions 19. This is usually done by means of a cutting torch. With the frame 12 free from the cables, the frame can now be lifted first vertically and then horizontally, away from the pour site. Remaining is the form 33. The elongated sides 34 are next removed, exposing the sides of the roadway segment 39. Then, the nuts and bolts holding the first and second bulkheads 36 and 37 are removed, allowing the split bulkheads to be removed from the pour site.

As shown in FIG. 28, a void 59 now exists between existing roadway segment 55 and new roadway segment 39. This void essentially represents the space taken up by the bulkhead and the outrigger assembly during the pour. By undertaking a second pour, and filling void 59, an expansion joint 61 is thereby created. It should also be noted that cables extending from adjacent ends of segments 39 and 55 may be joined before the second pour, through the use of splice chucks (not shown). In that way, the roadway segments may further be secured together to resist buckling and heaving.

Figure 27:
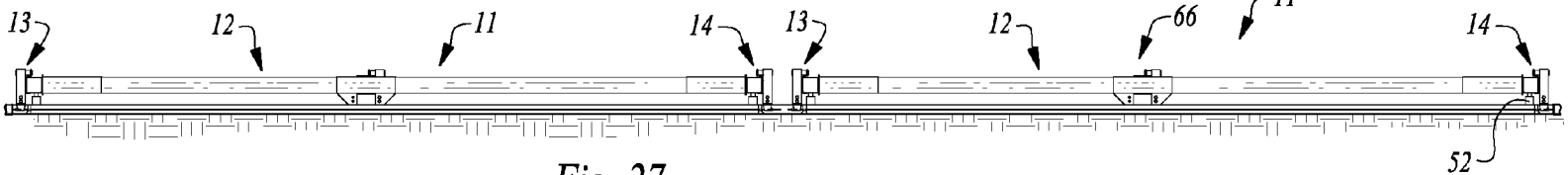
FIG. 27 is a side elevational view, showing two pre-stressing frames in end-to-end relation, configured to form a new roadway.

An alternative method of pouring is shown in FIG. 27, where two of the frames 12 are set up and arranged in end-to-end relation, to create two new roadway segments 39 at essentially the same time. Although the pouring process is identical to that just described, as illustrated in FIG. 28, the roadway segments are separated by avoid 62 which is wider than the void 59 resulting from employing the first method. This wider void is created by the space taken up by the two bulkheads and the two outrigger assemblies associated with adjacent ends of the frames 12. When a second pour is made to fill void 62, it necessarily forms a wider expansion joint 63, shown in FIGS. 28 and 30.

When multiple lanes of a roadway are manufactured using the apparatus 11, such as the three lane construction shown in FIG. 28, it is evident that when undertaking side-by-side pours of roadway segments 39, one side 34 of the form 33 is not used. The adjacent side of an existing roadway segment 55 effectively provides the other side of the form. The bulkheads are arranged in contingent relation with this side of the roadway segment 55, and act in conjunction with one side 34 to confine the pour.

Figure 21:
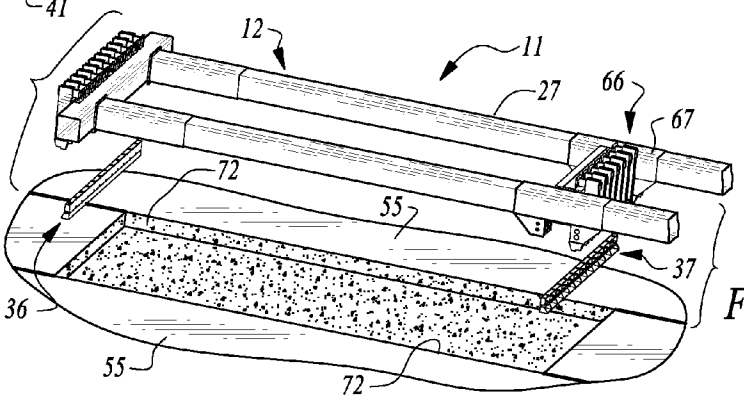
FIG. 21 is a perspective view of a roadway repair site, showing the cutout portion of the roadway, the bulkheads, and the pre-stressing frame.

Another scenario where the apparatus 11 may be used advantageously, is to repair an old roadway 64 which has become cracked, vertically displaced, or otherwise damaged. First, the damaged section of the old roadway is defined, by cutting around the damaged section using conventional concrete saws. The concrete within the damaged section is subsequently removed and the floor of the excavation is graded. The apparatus 11 is then moved into place, in spaced relation above the excavation, using jacks 52 resting on the adjacent old roadway 64. Since the existing sidewalls of the old roadway 64 effectively provide the sides of the form 33, only the bulkheads 36 and 37 need to be installed to confine the pour, as shown in FIG. 21. In addition, such damaged sections are not usually the full 60' length of the frame 12, but rather assume different special lengths depending upon the extent of the roadway damage.

Figure 7:
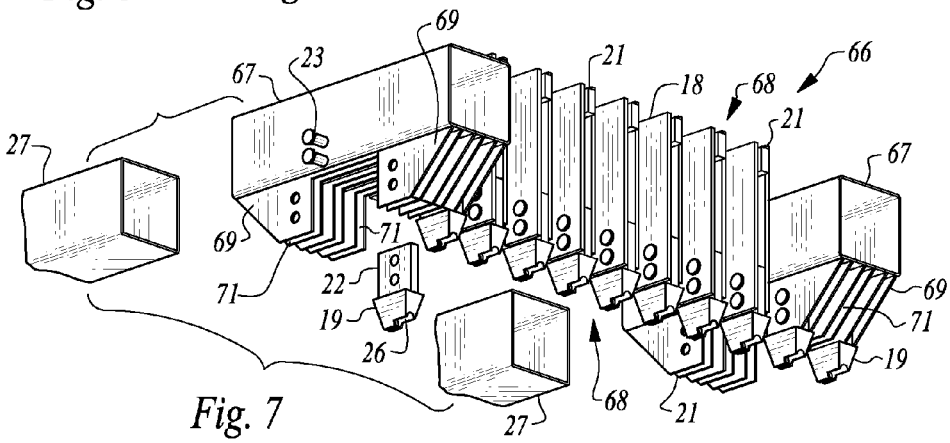
FIG. 7 is an exploded perspective view taken from a low angle, showing the outrigger assemblies used on the secondary outrigger frame.

To accommodate the need to manufacture a shorter roadway segment length, frame 12 may be fitted with a secondary outrigger frame 66, shown in detail in FIG. 7. Frame 66 includes a pair of tubular sleeves 67, each mounted in slidable relation over a respective side rail 27. Sleeves 67 are interconnected by a cross-member 68 forming a rigid "H" shaped frame. Cross-member 68 is also provided with a pair of angle irons 26 mounted so that a portion of the irons are maintained in spaced relation above the cross-member's upper surface.

Secondary outrigger frame 66 also includes a plurality of outrigger assemblies 68 identical to assemblies 16 and 17, described above. Each of these assemblies includes a receiver 18 and a cable restraint extension 19. Each receiver 18 further includes a slot portion 21 to receive a tongue portion 22 of an extension 19, and the two structures are secured together by means of removable pins 23. A chuck recess 20 is also provided in the lower end of extension 19, to receive the nose portion of a chuck 54.

Figure 24:
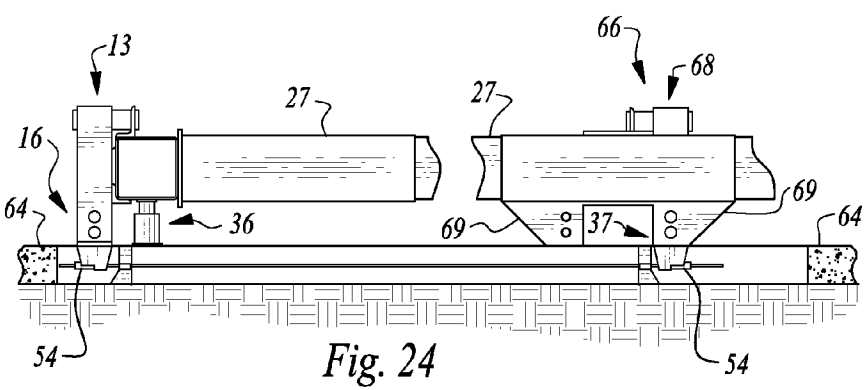
FIG. 24 is a side elevational view of the pre-stressing frame used in conjunction with the secondary frame, in preparation for the pour of a short roadway segment.
Figure 23:
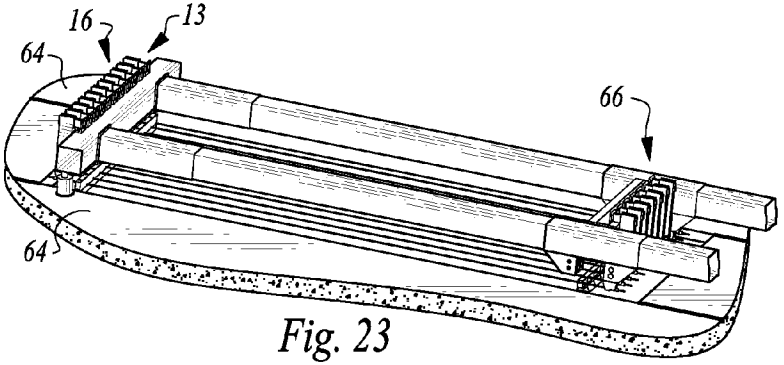
FIG. 23 is a perspective view as in FIG. 21, but showing the bulkheads and the pre-stressing frame installed in the cutout portion of the roadway.

Because there may be a need to locate one or more of the pre-stress cables 41 immediately beneath sleeves 67, a plurality of receiver plates 69 are attached to the underside of sleeves 67. These receiver plates include a slot 71 which is sized and configured to receive tongue portion 22 of an extension 19. It should be noted that there are opposing pairs of receiver plates in longitudinal alignment to accommodate an extension 19. The right hand pairs of receiver plates 69 will be used when the cables are strung from the first outrigger assembly 16 to the secondary outrigger frame. (See, FIGS. 23 and 24). And, the left hand pairs of receiver plates 69 will be used when the cables are strung from the second outrigger assembly 17 to the secondary outrigger frame 66.

FIG. 21 shows the frame 12 with the secondary outrigger frame 66 properly positioned along side rails 27 for pouring a roadway segment which is relatively short. Means such as compressive or wedging fixtures (not shown) are provided for selectively locking the frame 66 in position along rails 27. As indicated, only first and second bulkheads 36 and 37 are required in this application, as the sidewalls 72 of the existing roadway segments 55 provide the side portions of the form required for the pour. For this application, where end space is limited, it may be desirable to run and pre-stress cables 41 before frame 12 is lowered into place within the excavation. Alternatively, frame 12 is lowered into the excavation in the same manner previously described, before the cables 41 are strung and pre-stressed. (See, FIGS. 23 and 24).

Figure 22:
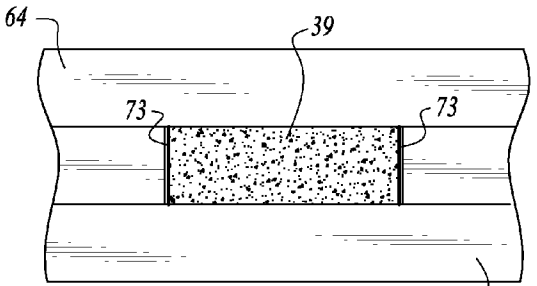
FIG. 22 is a top plan view, showing the roadway of FIG. 21, after repair.
Figure 26:
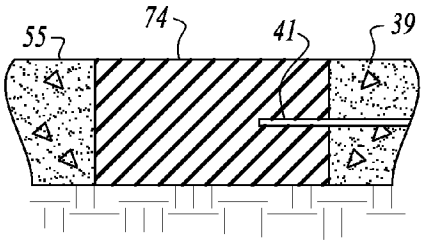
FIG. 26 is a cross-sectional view, taken on the line 26-26, shown in FIG. 25.
Figure 25:
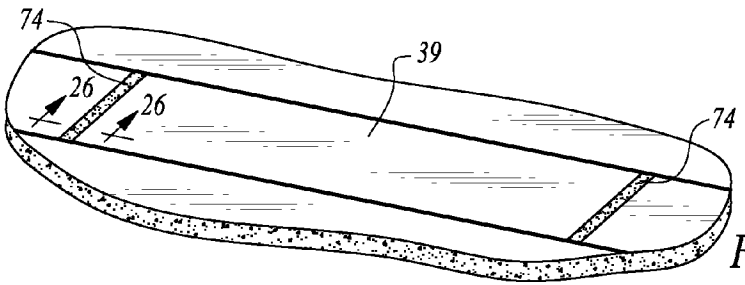
FIG. 25 is a perspective view of a repaired roadway, showing expansion joints at each end of the roadway repair segment.

After the concrete has been poured and has had a sufficient amount of time to cure, the frame 12 and the bulkheads 36 and 37 are removed from the excavation, leaving the new roadway segment 39, shown in FIG. 22. Because a void 73 is left at each end of segment 39 from the removal of the outrigger assemblies and the bulkheads, a second pour into each void creates expansion joints 74 to complete the repaired roadway segment 39. (See, FIGS. 25 and 26).

For the purpose of manufacturing beams, posts, and the like, a frame 76, having a more compact configuration, may be utilized. Frame 76 comprises an elongated "I"-Beam member 32, a coupler sleeve 77, and transverse end rails 28 and 29. Although only one end of frame 76 is shown in FIGS. 31 and 32, it will be understood that the opposite end of frame 76 is identical in structural features to that which is shown. End rails 28 and 29 are fitted with outrigger assemblies 78, identical in features but fewer in number than the outrigger assemblies 16 an 17 described previously.

The apparatus 11 employing frame 76, also includes a form 79, having elongated sides 81 and split bulkheads 82, identical in all respects except size, with those corresponding components previously described. In this application, the frame 76 is lowered over the form 79, and supported by jacks 52. Cables 41 are strung between the outrigger assemblies, and the height of the frame is adjusted so that the cables lie below an upper edge 83 of the form 79. The cables are then prestressed using a conventional pre-stressing fixture, and locked in place with a chuck 54 nested within a respective cable restraint extension 19.

With the apparatus 11 fully prepared, concrete is then poured into form 79 until its upper surface reaches upper edge 83. After the concrete is cured, the cables 41 are cut and frame 76 is removed from the pour site. After the bulkheads 82 and the sides 81 are removed, an elongated pre-stressed post 84 remains, as shown in FIG. 33.

It is also apparent that in a particular application, it may be desirable to have additional sets of cables 41, interspersed throughout a concrete structure such as a post, pole, or beam. In other words, in addition to having one set of cables 41 arranged in a horizontal plane as shown in FIG. 33, for additional strength, additional pre-stressed cables could be included in the concrete structure at different heights and patterns. This could be accomplished by having a three or four part split bulkhead, having cable passages at different elevations and locations. This would also require that the receivers and the cable restraint extensions be of different overall lengths, to secure the pre-stressed cables at alternative heights and locations throughout the poured concrete structure.

What is claimed is:

1. A method for pouring a pre-stressed concrete structure in the field, comprising the steps of:

a. providing a form in the field, said form defining a shape and a size for the structure, said form having opposing elongated sides and opposing first and second bulkheads transverse to said sides, said form having an upper edge defining an upper surface for the structure;

b. providing an elongated cable pre-stressing frame, said frame having a first end and a second end, and said frame including at least one pre-stressed cable extending from said first end to said second end, said cable passing through said first and second bulkheads;

c. positioning and maintaining said pre-stressing frame over and generally in longitudinal alignment with said form, with said at least one pre-stressed cable lying below said upper edge of said form;

d. pouring concrete into said form entirely covering said cable, and allowing said concrete to cure;

e. detaching said at least one cable from said first and second ends of said pre-stressing frame;

f. removing said pre-stressing frame from its location over said form; and, g. removing said first and second bulkhead from the ends of the concrete structure.

2. A method as in claim 1 including a plurality of pre-stressed cables extending from said first end of said frame to said second end of said frame.

3. A method as in claim 2 in which said form defines an elongated slab forming a section of roadway.

4. A method as in claim 3, including the further steps of repeating steps (a) through (g) at least a second time to pour a second elongated slab, the longitudinal axis of the form for the second elongated slab being aligned with the longitudinal axis of the first elongated slab.

5. A method as in claim 4, including the step of pouring an expansion joint between adjacent ends of said first and second elongated slabs.

6. A method as in claim 5 in which said plurality of cables extending from adjacent ends of said first and second elongated slabs are interconnected before said expansion joint is poured.

7. A method as in claim 1 in which said at least one pre-stressed cable is selectively pre-stressed to a predetermined tension after said frame is positioned and maintained over said form.

* * * * *